United States Patent [19]

Schupphaus et al.

[11] 4,265,488

[45] May 5, 1981

[54] TRACK ON A CONVEYOR FOR A MINING MACHINE

[75] Inventors: Herbert Schupphaus, Bochum; Hugo Klimeck, Velbert, both of Fed. Rep. of Germany

[73] Assignee: Gerb. Eickhoff Maschinenfabrik und Eisengiesserei m.b.H., Bochum, Fed. Rep. of Germany

[21] Appl. No.: 96,081

[22] Filed: Nov. 20, 1979

[30] Foreign Application Priority Data

Dec. 1, 1978 [DE] Fed. Rep. of Germany ..... 2851941

[51] Int. Cl.[3] ..... E21C 35/12

[52] U.S. Cl. ..... 299/43; 299/34

[58] Field of Search ..... 299/32, 34, 43–46; 238/243, 256

[56] References Cited

U.S. PATENT DOCUMENTS

| | | | |
|---|---|---|---|
| 4,162,810 | 7/1979 | Oberste-Beulmann | 299/43 |
| 4,205,882 | 6/1980 | Hauschopp et al. | 299/43 |

FOREIGN PATENT DOCUMENTS

| | | | |
|---|---|---|---|
| 2246233 | 3/1973 | Fed. Rep. of Germany | 299/34 |

*Primary Examiner*—Ernest R. Purser

*Attorney, Agent, or Firm*—Thomas H. Murray; Clifford A. Poff

[57] ABSTRACT

Track sections are attachedto the working face side of a face conveyor to form a track for a mining machine. The track sections have a rolled profile forming an L-shaped cross section with upright limbs pivotally interconnected at their ends by projecting sections of coupling plates facing the mine face to receive a chain link. A bead projects toward the mine face on the top of the upright limb to prevent collisions between the mining machine and the parts for pivotally interconnectng the track sections. The bead overlies the major part of an inclined surface of a transition section extending from the upright limb to a thickened lateral limb projecting toward the mine face for supporting the mining machine.

6 Claims, 4 Drawing Figures

1
2
3
5
6
7
8
9
10
11
12
14
15
II
III
IV

TRACK ON A CONVEYOR FOR A MINING MACHINE

BACKGROUND OF THE INVENTION

This invention relates to a track attached to the working face side of a face conveyor for a drum cutter mining machine and, more particularly, to such a track having individual sections pivotally interconnected by couplings on an upright limb of each track section defined by a L-shaped cross section and forming a horizontal or lateral limb pointing toward the working face of a mine and bearing on the mine floor.

Machine tracks of this same general type are known in the art. The known track is made of individual angle iron sections that are welded together to form a box-shaped angle section. At the end of each track section there is a recess in the vertical limb of the track section wherein parts for the coupling are attached by welding. The parts for the coupling include a projection extending toward the working face of the mine. A chain link is used to form the actual coupling means that pivotally interconnects two projections at two adjacent ends of the track sections. The chain link is fitted onto the immediately adjacent projections to enclose them and held in place on the projections by connecting members that are releasably secured to the track.

After a mining run during which a drum cutter mining machine is moved along the mine face so that the cutter drums release material from the mine face, the mining equipment is advanced toward the receding mine face. When the drum cutter mining machine is moved from the part of the face conveyor which has not as yet been advanced to the part of the face conveyor which has already been advanced, the mining machine must pass through a conveyor section that is bent in the form of an "S". In this bent section of the conveyor, particularly if the conveyor trough sections are bent at a considerable angle, the runners of the mining machine at the working face side inevitably collide at various occasions with the trough connection parts that project into the machine track. If such collisions occur repeatedly at frequent intervals, the connecting members are damaged as a result of the collisions. The machine runners and machine track are also damaged. Moreover, to obtain the track profile in a welded structure with the necessary strength, a profiled sheet is extended over the height of the track on the working face side and disposed to slope downwardly at the bottom so that the bottom longitudinal edge projects in the plane of the track toward the working face. This construction causes the runners of the mining machine to climb the inclined surface of the machine track. In addition, openings are provided in the top edge of the metal to receive attachment bolts which weaken the metal and reduce the stiffness of the track.

SUMMARY OF THE INVENTION

It is an object of the present invention to provide a machine track which is more suitable for a drum cutter mining machine and which is so designed and dimensioned to prevent collisions between a runner for the mining machine and coupling means to adjoin track sections together.

A further object of the present invention is to provide a machine track for a drum cutter mining machine wherein the track is constructed and designed to accommodate imposed loads due to the weight of the mining machine traction forces due to a winch or other propulsion drive systems and imposed pressures by advancing cylinder actuators.

More particularly, according to the present invention, there is provided a track on the working face side of a face conveyor to carry support means of a drum cutter mining machine upon a mine floor for movement along a mine face, the track including a plurality of track sections each having an L-shaped cross section defining an upright limb on the working face side of the face conveyor and a generally lateral limb projecting for support upon the mine floor, a track coupling member secured within a cavity in the upright limb at each terminal end portion of a track section, each coupling member including a mounting plate section having a thickness less than the thickness of the upper limb and a coupling section projecting from the mounting plate section, coupling means to interconnect track coupling members on upright limbs of adjacent track sections on the working face side thereof for pivotal movement of the track sections, the upper limb including a bead along the top longitudinal portion projecting above the lateral limb to overlie the coupling means and the track coupling member, the bead including an inclined surface extending to the surface of the upright limb facing toward the mine face, the upper limb of each track section merging with the lateral limb by a transition section having an inclined top surface at least partially underlying the bead and sloped downwardly toward the mine floor to the lateral limb.

Thus, the track of the present invention provides that: (a) the upright limb fastened onto the side wall of the face conveyor has, in the region of its top longitudinal edge, a bead projecting toward the mine face; (b) the bead projects toward the mine face by an amount equal to at least the size of the coupling means and the coupling member which is attached to the upright limb and receives the coupling means; (c) the upright limb has a thickness which substantially surmounts the mounting plate of the coupling member attached thereto in a recess by welding whereby, for example, the thickness of the upper limb is such that at the bottom region thereof it merges into the lateral limb projecting toward the mine face, the transition being a section that includes an inclined surface which slopes toward the mine floor and which terminates just above the bead edge on the working face side; (d) the inclined surfaces situated in the interior of the track profile between the upright and the lateral limbs as well as the upright limb and the outer edge of the bead extend at an angle equal to at least the inclination of the drum; and (e) the L-shaped cross section of the track is designed for manufacture without cutting and preferably made as a rolled profile.

A machine track constructed according to the present invention has the same stability and a lighter weight as compared with a machine track produced in the form of a welded structure. The design of the machine track, according to the present invention, has the distinguishing advantage of a considerably reduced production cost. Moreover, the design of the machine track according to the present invention prevents any climbing movement of the mining machine because the inclined surface merging into the runner support surface rises only slightly toward the face conveyor without reducing the stability and stiffness to the cross-sectional profile of the track. The bead overlies, to a large extent, the inclined surface which renders it inaccessible to the runners of the mining machine. Another great advantage of this machine track construction is that the thickness of the track profile is increased by the bead which prevents any collision between the machine runners and the coupling means or projections engaged therewith; thus, preventing any damage to the coupling means and mating structure on the upright limb.

According to a further feature of the present invention, the lateral limb which projects toward the mine face is provided with a thickness that is greater than the thickness of the upright limb. This greatly reduces the weight of the track because the two limbs of the track cross-sectional profile do not require dimensional sizes to accommodate loads which are imposed when the drum cutter passes along the track. This is because such loads may vary largely in the laterally-projecting limb that extends toward the mine face if the floor is uneven due to the load applied at this point by the weight of the machine.

Advantageously, the surface of the upright limb facing the face conveyor has at the top and bottom zones thereof, a contact surface in the form of a strip extending along the length of the track section to insure that the machine track is satisfactorily installed onto the face conveyor wall at the working face side thereof.

These features and advantages of the present invention as well as others will be more fully understood when the following description is read in light of the accompanying drawings, in which.

Figure 1:
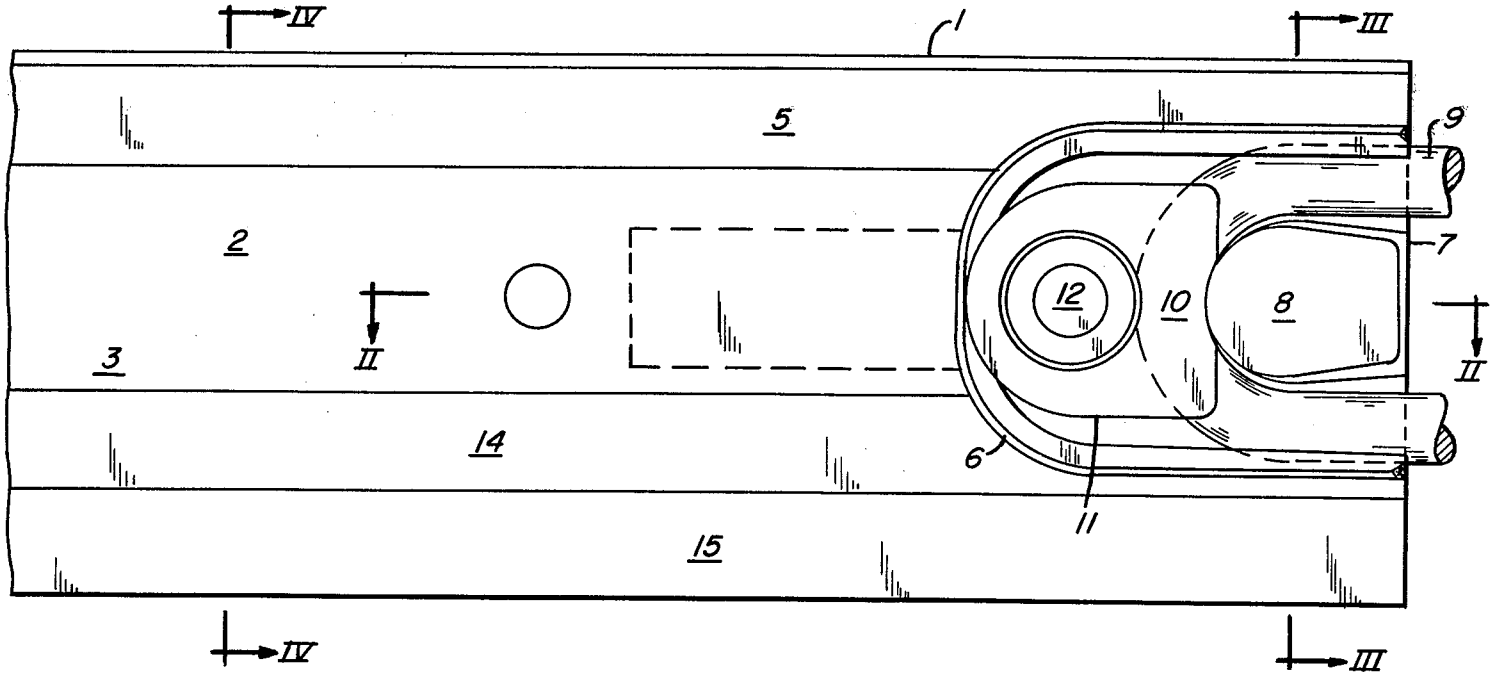
FIG. 1 is an elevational view of a machine track attached to the working face side of a face conveyor.
Figure 2:
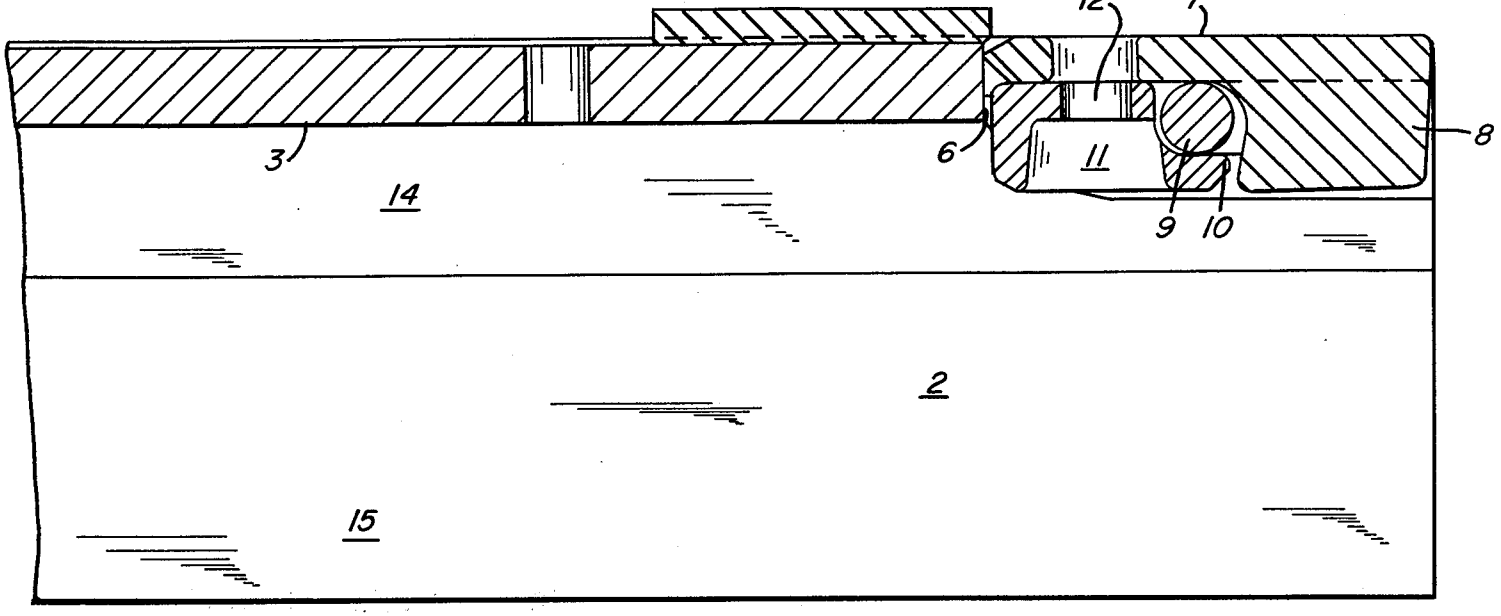
FIG. 2 is a sectional view taken along line II—II of FIG. 1.
Figure 3:
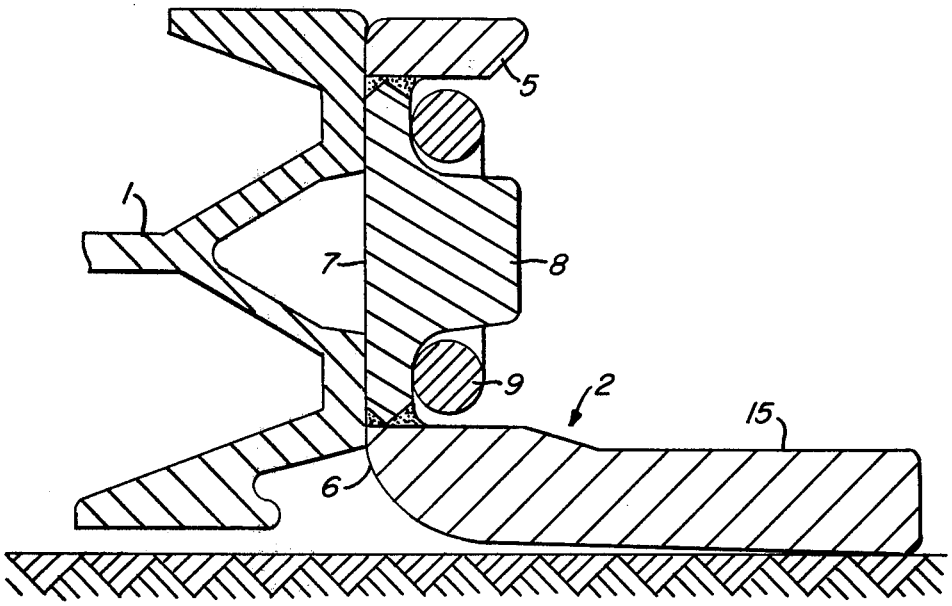
FIG. 3 is a sectional view taken along line III—III of FIG. 1.
Figure 4:
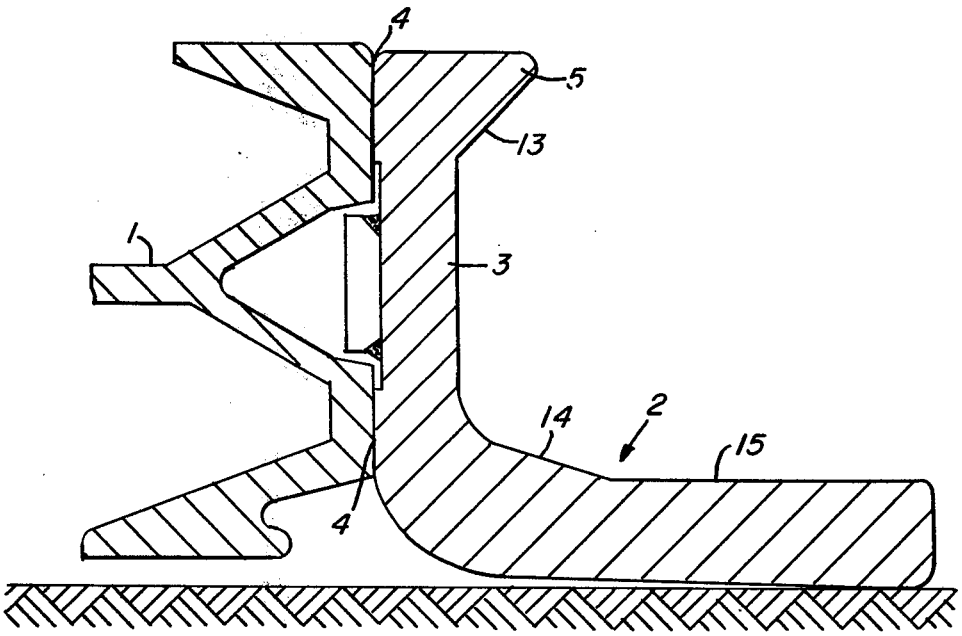
FIG. 4 is a sectional view taken along line IV—IV of FIG. 1.

In FIGS. 1-4 of the drawings, reference numeral 1 identifies a face conveyor onto which there is attached on the side thereof facing toward the working face of the mine, not shown, a machine track 2. The face conveyor 1 and the machine track 2 are each made up of divided sections with the length of a track section corresponding to the length of a conveyor trough section. As shown in FIG. 4, the individual sections of the track 2 have an L-shaped cross-sectional profile that essentially includes a vertical or upright limb 3 extending substantially over a distance corresponding to the height of the face conveyor 1. The upright limb bears against the side wall of the face conveyor by means of two contact surfaces 4. Surfaces 4 take the form of strips extending over the length of each track section at top and bottom zones thereof. A bead 5 projects from the top of the upright limb 3 toward the working face of the mine. A recess 6 forms a cavity in the upright limb at each terminal end portion of a track section. A coupling plate 7 is dimensioned to fill the recess and is rigidly attached by welding. Plate 7 is positioned in the recess such that one face surface thereof which is directed toward the face conveyor 1 is flush with the surface of the upright limb that is also directed toward the conveyor. The opposite face surface of plate 7 has a projection 8 forming a coupling section extending in a direction toward the mine face. A chain link 9 is fitted over the projections 8 at the ends of two adjacent track sections to form a pivotal interconnection. A nose section 10 of a retaining member 11 engages the chain link 9 at each of the projections 8. The retaining member has a bore 12 through which a bolt, not shown, extends to form a releasable connection to the face conveyor.

As clearly shown in FIG. 2, the upright limb has a thickness in cross section that is greater than the thickness of the coupling plate 7. By this construction, the plate 7 and the projection 8 extending therefrom toward the working face as well as the chain link 9 lie within the recess 6 in the upright limb. The bead 5 which extends over the entire length of the machine track section covers the retaining member 11 and the part of the projection 8 which extends from the upright limb 3. As shown in FIG. 4, the bead 5 merges at the bottom by way of an inclined surface 13 into the upright limb 3 forming the L-shaped track profile. The inclined surface 13 substantially covers an inclined surface 14 which forms part of a transition section between the upright limb 3 and the lateral limb 15 of the track 2. The lateral limb 15 has a thickness in cross section which is greater than the corresponding thickness of the upright limb whereby the heavy loads to which the lateral limb is subjected are accommodated, particularly in the event of an uneven mine floor. The heavy loads occur due to the weight of the machine imposed by its runner at one point. The lateral limb is supported upon the mine floor over its entire length only in the region of its leading edge as shown in FIGS. 3 and 4. In this way, debris remaining in the mining are behind the mining machine is completely taken up or pushed up to the new working face of the mine as it recedes. In view of the foregoing, it will be apparent to those skilled in the art, that the machine track as shown in FIG. 4 is formed without cutting and is preferably constructed as a rolled profile. For this purpose, the inclined surfaces 13 and 14 extending from the vertical limb 3 are inclined at an angle following the track profiles to be produced without cutting.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A track on the working face side of a face conveyor to carry support means for a drum cutter mining machine upon a mine floor for movement along a mine face, said track including a plurality of track sections each having an L-shaped cross section defining an upright limb on the working face side of said face conveyor and a generally lateral limb projecting for support upon the mine floor, a track coupling member secured within a cavity in the upright limb at each terminal end portion of a track section, each coupling member including a mounting plate section having a thickness less than the thickness of the upper limb and a coupling section projecting from said mounting plate section, coupling means to interconnect track coupling members on upright limbs of adjacent track sections on the working face sides thereof for pivotal movement of the track sections, said upper limb including a bead along the top longitudinal portion projecting above the lateral limb to overlie said coupling means and said track coupling member, said bead including an inclined surface extending to the surface of the upright limb facing toward the mine face, the upper limb of each track section merging with the lateral limb by a transition section having an inclined top surface at least partially underlying said bead and sloped downwardly toward the mine floor to the lateral limb.

2. The track according to claim 1 wherein each track section is constructed as a rolled profile.

3. The track according to claim 1 wherein the L-shaped cross section of a track section is constructed without cutting.

4. The track according to claim 1 wherein the inclined surface of said bead and said inclined top surface extend at an angle equal to at least the drum inclination angle.

5. The track according to claim 1 wherein said lateral limb has a thickness greater than the thickness of said upright limb.

6. The track according to claim 1 wherein said upright limb defines a strip-like contact surface extending the length of each track section at each of top and bottom zones directed toward the face conveyor.

* * * * *